US009759208B2

(12) United States Patent
Chou

(10) Patent No.: US 9,759,208 B2
(45) Date of Patent: Sep. 12, 2017

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 217 days.

(21) Appl. No.: 14/664,257

(22) Filed: Mar. 20, 2015

(65) Prior Publication Data

US 2015/0285237 A1 Oct. 8, 2015

(30) Foreign Application Priority Data

Apr. 7, 2014 (TW) ..... 103112756 A

(51) Int. Cl.

| | |
|---|---|
| ***F04B 35/04*** | (2006.01) |
| ***F04B 39/12*** | (2006.01) |
| ***F04B 49/03*** | (2006.01) |
| ***F04B 39/08*** | (2006.01) |
| ***F04B 41/02*** | (2006.01) |

(52) U.S. Cl.

CPC ..... *F04B 39/08* (2013.01); *F04B 35/04* (2013.01); *F04B 39/121* (2013.01); *F04B 41/02* (2013.01); *F04B 49/03* (2013.01)

(58) Field of Classification Search

CPC ..... F04B 35/04; F04B 39/121; F04B 39/123; F04B 49/03

USPC ..... 417/234, 415

See application file for complete search history.

(56) References Cited

U.S. PATENT DOCUMENTS

| | | | | |
|---|---|---|---|---|
| 7,240,642 | B2 * | 7/2007 | Chou | F04B 39/123 123/41.35 |
| 8,297,944 | B2 * | 10/2012 | Chou | F04B 35/008 285/33 |
| 8,522,833 | B2 * | 9/2013 | Chou | F04B 35/008 141/38 |
| 9,328,725 | B2 * | 5/2016 | Chou | F04B 39/123 |
| 2012/0121443 | A1 * | 5/2012 | Chou | F04B 35/04 417/297 |
| 2013/0011283 | A1 * | 1/2013 | Chou | F04B 35/04 417/437 |
| 2014/0286804 | A1 * | 9/2014 | Chou | F04B 7/0057 417/510 |
| 2015/0184668 | A1 * | 7/2015 | Chou | F04B 35/04 415/118 |
| 2015/0285236 | A1 * | 10/2015 | Chou | F04B 35/04 417/415 |

* cited by examiner

*Primary Examiner* — Peter J Bertheaud

(57) ABSTRACT

An air compressor includes a cylinder being fitted with a piston body and an air storage container formed integrally with the cylinder The air storage container defines therein an air chamber having a diameter greater than or equal to the inner space of the cylinder A pressure relieving mechanism is directly mounted to the air storage container rather than at one outlet provided at the air storage container, wherein one portion of the pressure relieving mechanism is located in the air chamber of the air storage container while the other portion of the pressure relieving mechanism extends out of the air storage container to be in contact with a push button provided on an external enclosure, whereby a user may depress the push button to reduce the air pressure within the air storage container.

7 Claims, 10 Drawing Sheets

AIR COMPRESSOR

(a) TECHNICAL FIELD OF THE INVENTION

The present invention relates to an air compressor and, more particularly, to an air compressor that includes an air storage container formed integrally with a cylinder thereof, wherein the air storage container is formed on top of the cylinder and defines therein an air chamber having a diameter greater than or equal to the inner space of the cylinder, and a pressure relieving mechanism is directly mounted to the air storage container such that one portion of the pressure relieving mechanism is located in the air chamber of the air storage container while the other portion of the pressure relieving mechanism extends out of the air storage container to be actuated by a user for reducing the air pressure within the air storage container.

(b) DESCRIPTION OF THE PRIOR ART

Most of existing air compressors have only two outlets or ducts, one of which can be connected with a pressure gauge and the other of which can be connected with a hose having an air nozzle for inflating an object. For improving the function of an air compressor, a multi-duct air compressor (U.S. Pat. No. 7,462,018 issued to the applicant) was disclosed. In the patent, the air storage container is provided with multiple ducts, wherein one of the ducts can be installed with a relief valve, so that when overpressure occurs in the air storage container or the cylinder, a user may operate the relief valve to release the air within the storage container into the ambient environment, so that the object to be inflated can be prevented from damages.

Since most of conventional air compressors should install a relief valve by way of one outlet provided at the air storage container, and furthermore, when an air compressor with a relief valve is mounted inside an enclosure, it is inconvenient for a user to operate the relief valve. For reducing the inconvenience of operating an air compressor with an external enclosure, there is a need to develop an improved air compressor that allows a user to directly actuate a pressure relieving mechanism on the external enclosure.

SUMMARY OF THE INVENTION

One object of the present invention is to provide an air compressor, wherein a pressure relieving mechanism can be directly mounted to an air storage container rather than at one outlet provided at the storage container, wherein one portion of the pressure relieving mechanism is located in the air chamber of the air storage container while the other portion of the pressure relieving mechanism extends out of the air storage container.

Another object of the present invention to provide an air compressor that includes an external enclosure and a compressor unit installed inside the external enclosure, wherein the compressor unit is provided at an air storage container thereof with a pressure relieving mechanism that can be actuated by a button provided on the external enclosure to reduce the air pressure within the air storage container.

A further object of the present invention is to provide an air compressor, which includes a cylinder being fitted with a piston body and an air storage container formed integrally with the cylinder, wherein the air storage container is provided with a pressure relieving mechanism, and the air storage container defines therein an air chamber having a diameter greater than or equal to the diameter of the inner space of the cylinder, so that the motion resistance of the piston body can be reduced and the pressure relieving mechanism can be operated more easily.

A still further object of the present invention is to provide an air compressor, which includes an air storage container being comprised of a main container shell and a cover, wherein a pressure relieving mechanism can be directly mounted to the main container shell or the cover so that, when the air pressure within the air storage container exceeds a predetermined pressure, a user may actuate the pressure relieving mechanism to release the compressed air within the air storage container into the ambient environment to reduce the air pressure.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
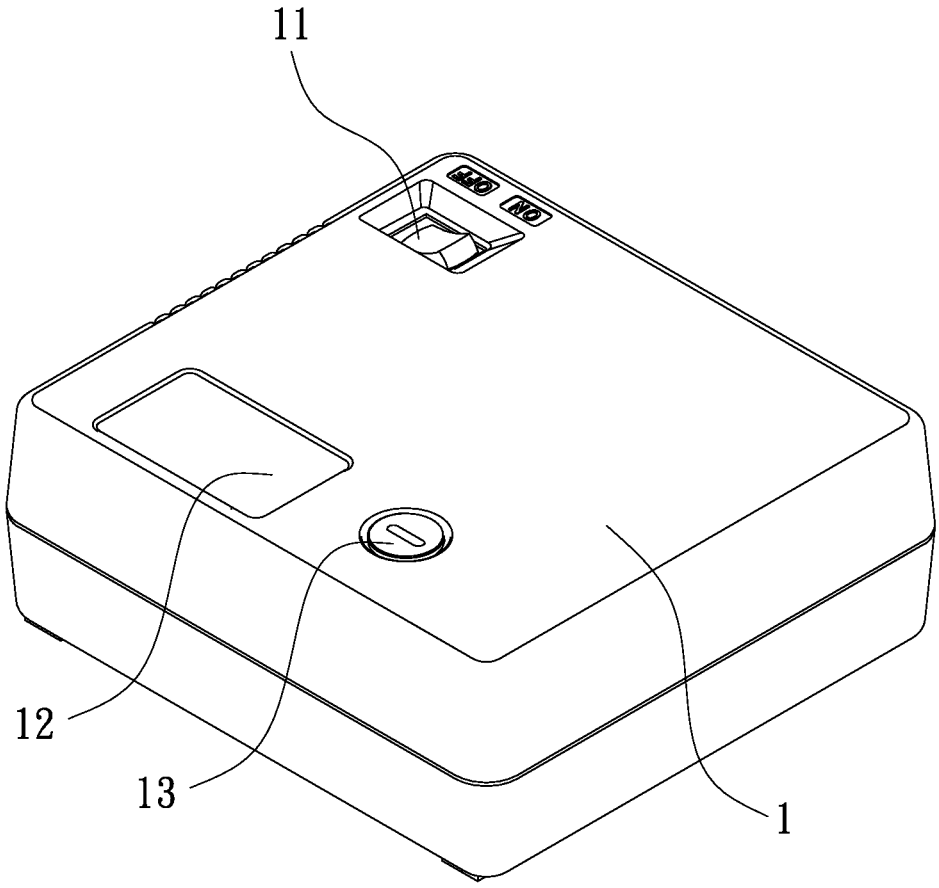
FIG. 1 shows a 3-dimensional view of an air compressor according to one embodiment of the present invention, wherein a compressor unit is installed inside an external enclosure.
Figure 2:
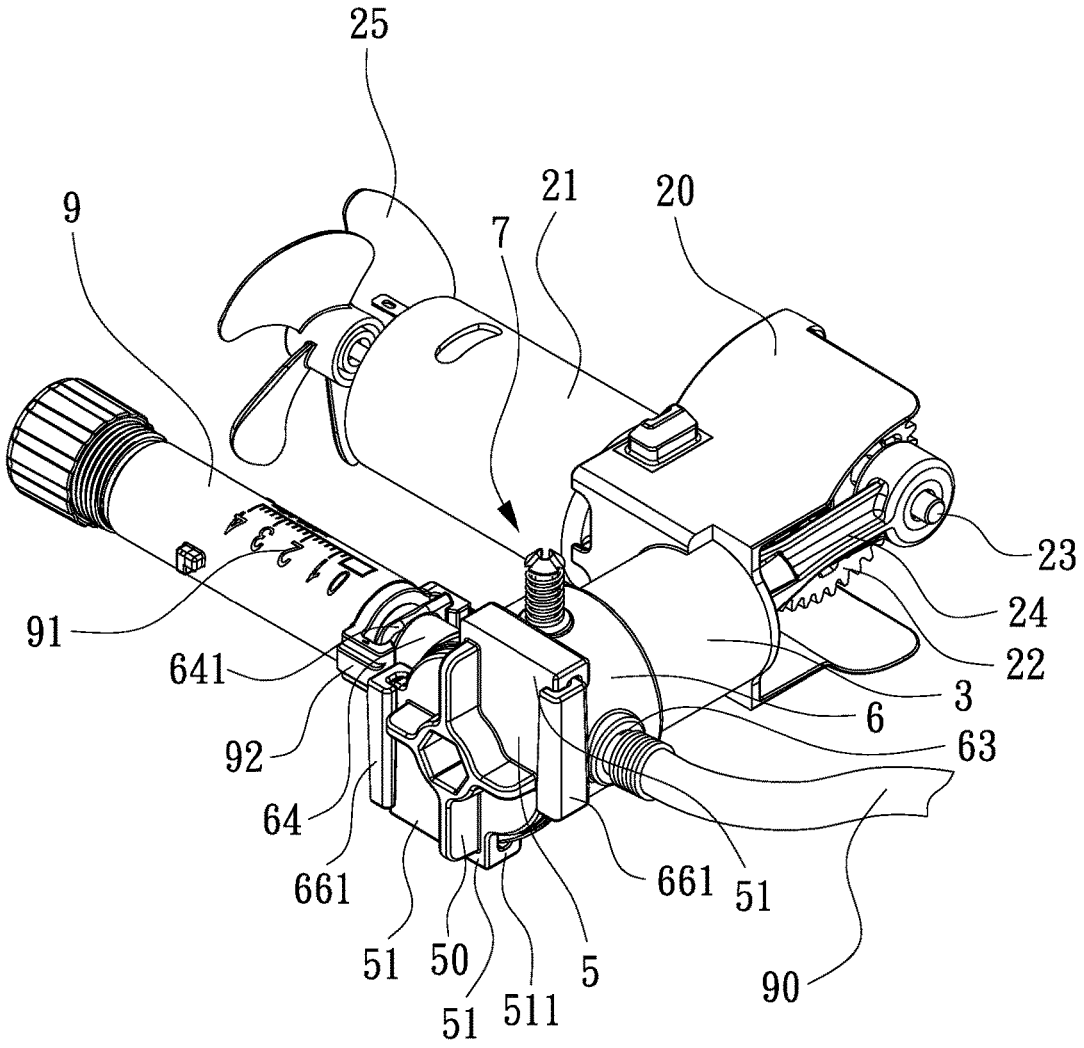
FIG. 2 shows a 3-dimensional view of a first embodiment of the compressor unit.

Referring first to FIGS. 1, 2, 3 and 4, an air compressor according to one embodiment of the present invention is shown, which generally comprises an external enclosure 1 and a first embodiment of a compress unit inside the external enclosure 1. The external enclosure 1 is provided at its outer surface with a rocker-type switch 11 electrically connected with the compressor unit, a window 12, and a push button 13. The compressor unit generally includes a cylinder 3 and a motor 21 mounted to a main frame 20, wherein the cylinder 3 and the main frame 20 are integrally formed. The cylinder 3 is fitted with a piston body 24. The motor 21 is provided with a cooling fan 25. A valve mechanism including a plug 41 and a compression spring 42 is used to control the compressed air within the cylinder 3 to enter an air storage container. Through a transmission mechanism including a small gear (not shown), a large gear 22, a crankpin 23, and a counterweight (not shown), the motor 21 can drive the piston body 24 to conduct reciprocating motion within the cylinder 3, so that the compressed air produced in the inner space 35 of the cylinder 3 can overcome the urging force of the compression spring 42, which forces the plug 41 to normally close a through hole 32, to have the plug 41 moved upwardly, so that the compressed air can enter the air storage container being comprised of a main container shell 6 and a cover 5, wherein the main container shell 6 is provided with a plurality of outlets 63, 64 (see FIG. 2). The outlet 63 can be connected with a hose 90. The outlet 64 is provided with a rectangular plate 641, which allows a pressure measuring device 9 to be quickly mounted. One primary feature of the present invention is that the main container shell 6 is formed integrally with the cylinder 3 at its bottom 60. The cover 5 is capable of sealing an open top 61 of the main container shell 6 to define therein an air chamber 62. The air chamber 62 of the main container shell 6 has a diameter greater than or equal to the inner space 35 of the cylinder 3 (see FIG. 4). The air storage container is not made in a form separated from the cylinder 3. The pressure relieving mechanism 7 is directly mounted to the air storage container rather than at one outlet provided at the air storage container, wherein one portion of the pressure relieving mechanism 7 is located in the air chamber 62 of the air storage container while the other portion of the pressure relieving mechanism 7 extends out of the surrounding wall 67 of the air storage container to be in contact with the push button 13, so that a user can operate the mechanism on the external enclosure 1 to reduce the air pressure. A further illustration for the pressure relieving mechanism 7 will be provided in the following paragraphs.

Figure 3:
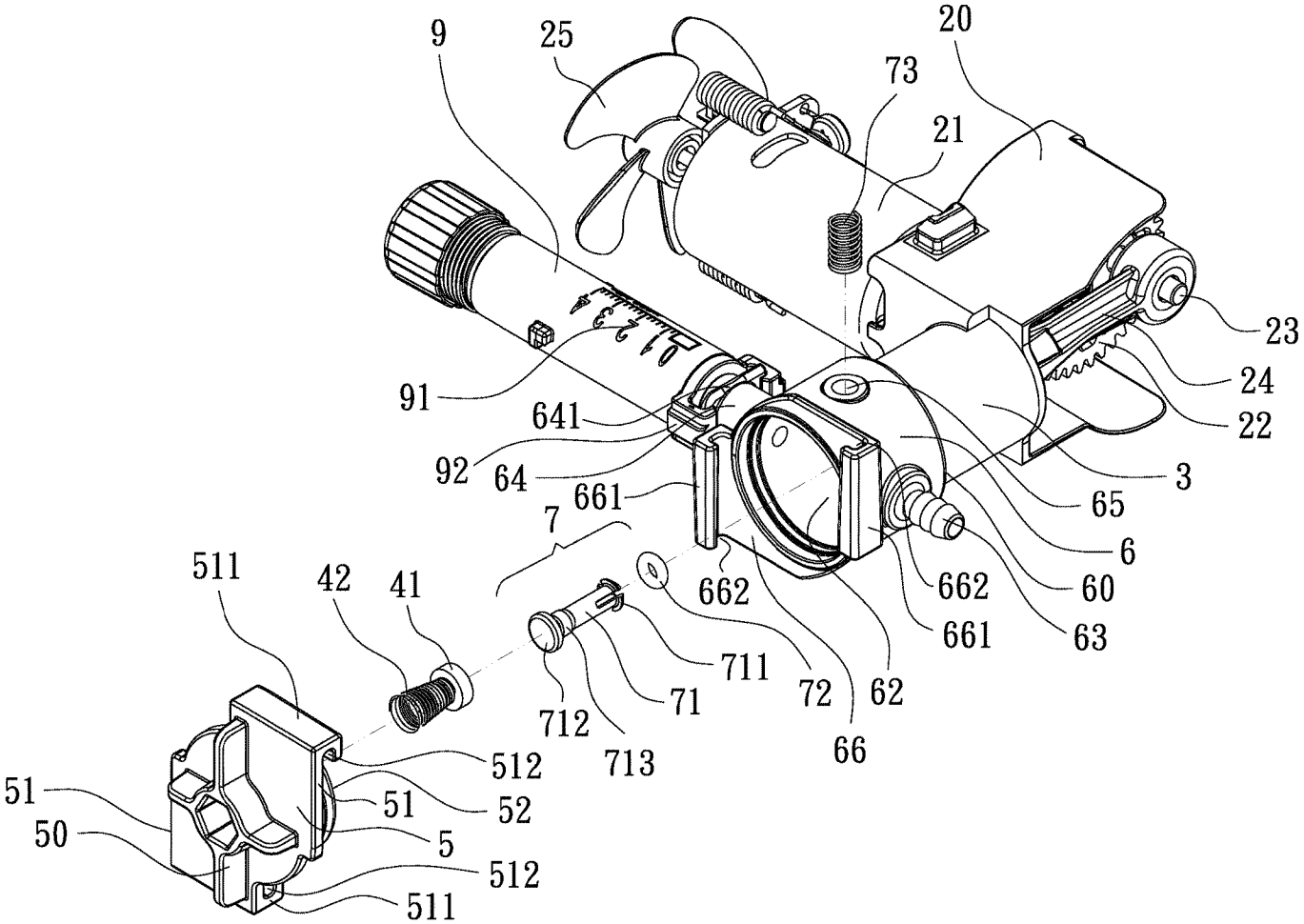
FIG. 3 shows an exploded view of the first embodiment of the compressor unit.
Figure 4:
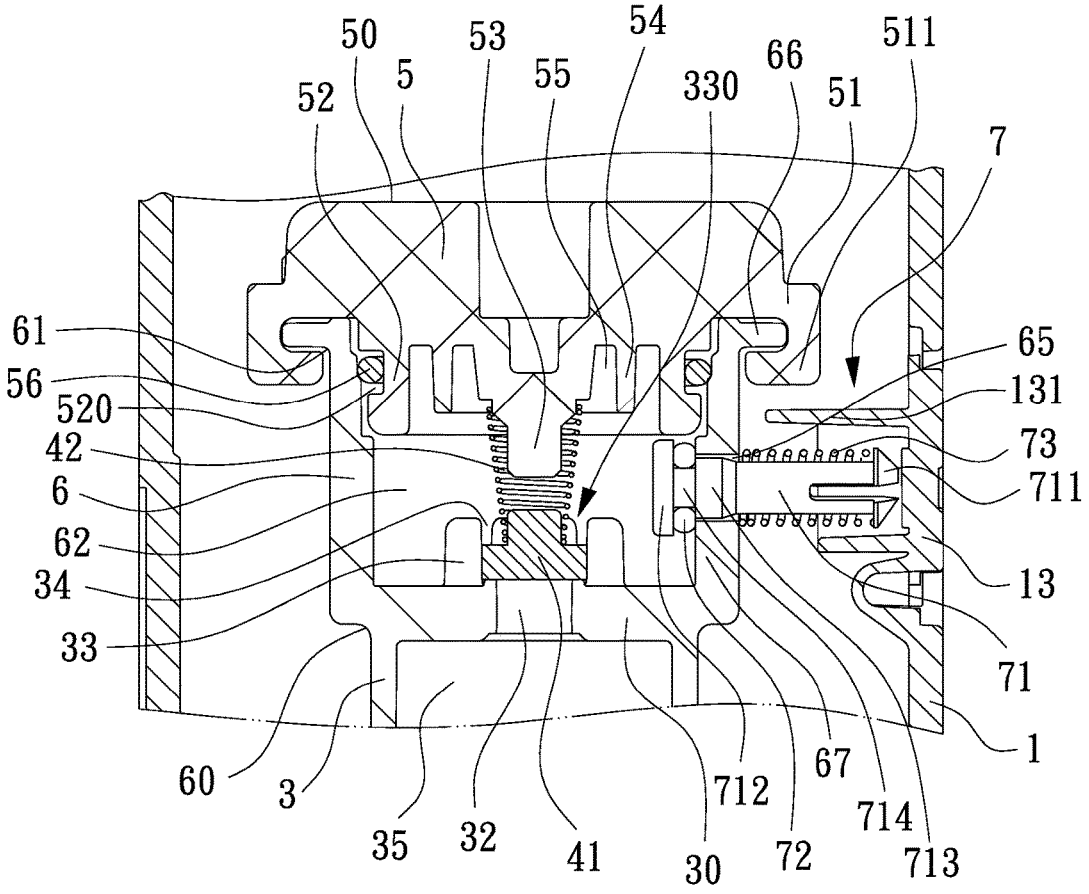
FIG. 4 shows a partially enlarged sectional view of the first embodiment of the compressor unit.

Referring to FIGS. 3 and 4, the main container shell 6 and the cylinder 3 share a partition wall 30 that defines the through hole 32 communicating the air chamber 62 of the air storage container with the inner space 35 of the cylinder 3. A plurality of posts 33 is formed on a top surface of the partition wall 30 and arranged around the through hole 32 thereof to define a central space 330 therebetween. There is a gap 34 existed between two adjacent posts 33. The compression spring 42 is disposed between the cover 5 and the plug 41. The plug 41 is urged by the compression spring 42 and located in the central space 330 surrounded by the posts 33 so that the plug 41 can be prevented from lateral movement under a force. The open top 61 of the main container shell 6 is formed with a first coupling means that includes two substantially opposite lateral plates 66 extending outwardly from the surrounding wall 67 of the main container shell 6. One side of each lateral plate 66 is formed into a first U-shaped holding portion 661 defining a first recess 662.

Referring again to FIGS. 3 and 4, the main container shell 6 defines at its surrounding wall 67 a through hole 65 that communicates the air chamber 62 with the ambient environment. The pressure relieving mechanism 7 includes a stem 71, a seal ring 72, and a compression spring 73, wherein the stem 71 has a resilient head 711 at one end, a bottom plate 712 at the other end, a neck 714 next to the bottom plate 712, and a protrusion 713 next to the neck 714. The seal ring 72 is fitted around the neck 714 of the stem 71. The stem 71 is inserted through the through hole 65 of the main container shell 6 and fitted with the compression spring 73 such that the resilient head 711 is located outside the main container shell 6 and in contact with the push button 13 provided on the external enclosure 1, while the bottom plate 712 is located inside the main container shell 6. The seal ring 712 is engaged between the bottom plate 712 and the main container shell 6. The compression spring 73 is disposed between the resilient head 711 and the main container shell 6, so that the stem 71 can be moved outwardly of the main container shell 6 to have the seal ring 72 in tight contact with the inner surface of the surrounding wall 67 of the main container shell 6 around the through hole 65, and thus the seal ring 72 normally seals the through hole 65 of the main container shell 6. Depressing the push button 13 will move the stem 71 inwardly of the main container shell 6, so that the through hole 65 of the main container shell 6 will not be sealed by the seal ring 72, so that the compressed air in the air chamber 62 of the air storage container can be released into the ambient environment by way of the through hole 65 of the main container shell 6 (see FIG. 5), thereby reducing the air pressure.

In this embodiment, the cover 5 is a flat body having two substantially opposite lateral plates 51. One side of each lateral plate 51 of the cover 5 is formed into a second U-shaped holding portion 511 defining a second recess 512. The outer surface of the cover 5 is provided with radial ribs 50 to facilitate a user to operate the cover 5. The cover 5 is formed with a tubular connection portion 52 extending downwardly from its inner surface. The tubular connection portion 52 defines an annular groove 520 around its circumference to be fitted with a seal ring 56. The inner surface of cover 5 is further formed with a central column 53 and an annular protrusion 54 around the central column 53, thus defining an annular groove 55 between the central column 53 and the annular protrusion 54. One end of the compression spring 42 of the valve mechanism is fitted around the central column 53 and received in the annular groove 55.

In assembling the cover 5 to the main container shell 6 (see FIGS. 1 through 5), the tubular connection portion 52 of the cover 5 can be inserted into the main container shell 6. Next, the cover 5 can be rotated about the main container shell 6 to allow its lateral plates 51 to slide in the first recesses 662 of the main container shell 6, and allow the lateral plates 66 of the main container shell 6 to slide in the second recesses 512 of the cover 5, so that the cover 5 is detachably mounted to the main container shell 6 and thus seals the open top 61 of the main container shell 6, thereby completing an air storage container. Furthermore, the pressure measuring device 9 is provided with two U-shaped holding portions 92, which can retain the rectangular plate 641 of the outlet 64, so that the pressure measuring device 9 can be quickly mounted to the outlet 64. Through the window 12 of the external enclosure 1, a user can see the scale 91 of the pressure measuring device 9.

Figure 5:
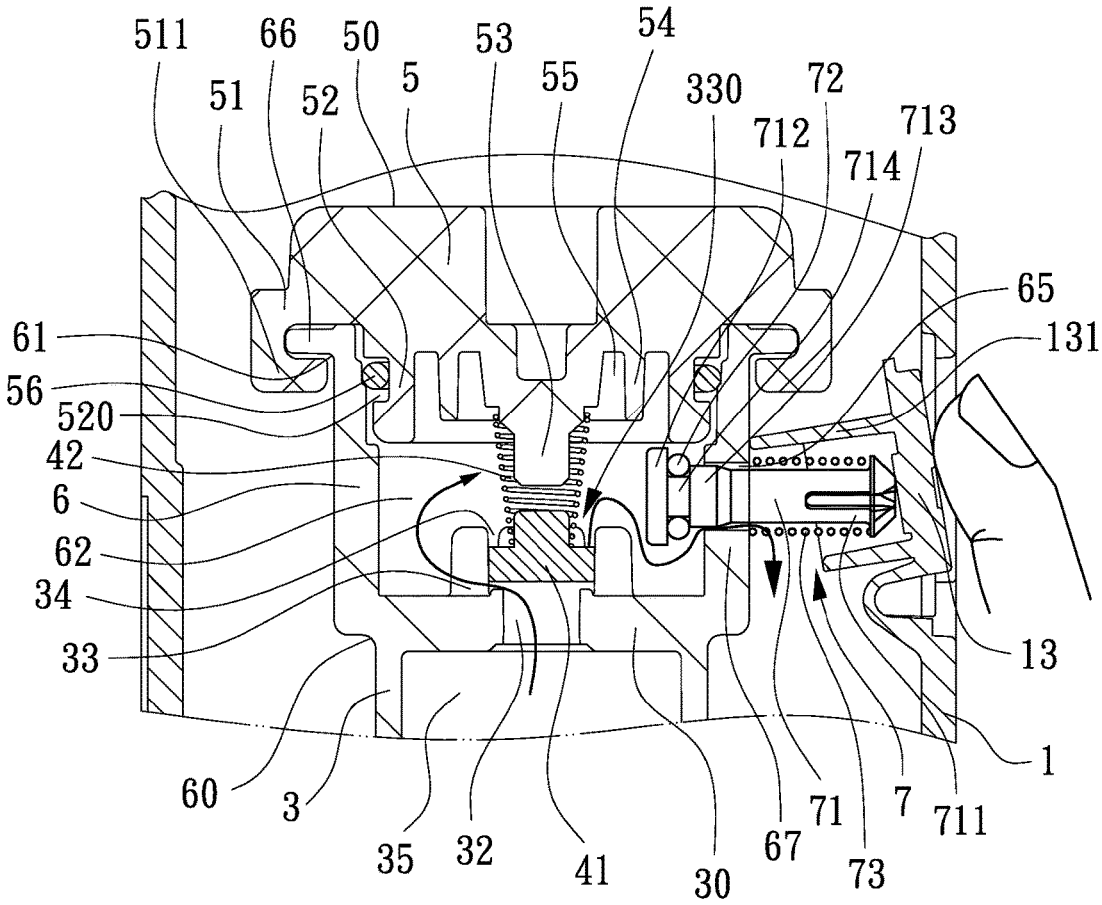
FIG. 5 shows an operational view of the first embodiment of the compressor unit, wherein a pressure relieving mechanism thereof is actuated for releasing the compressed air within an air storage container thereof into the ambient environment.
Figure 6:
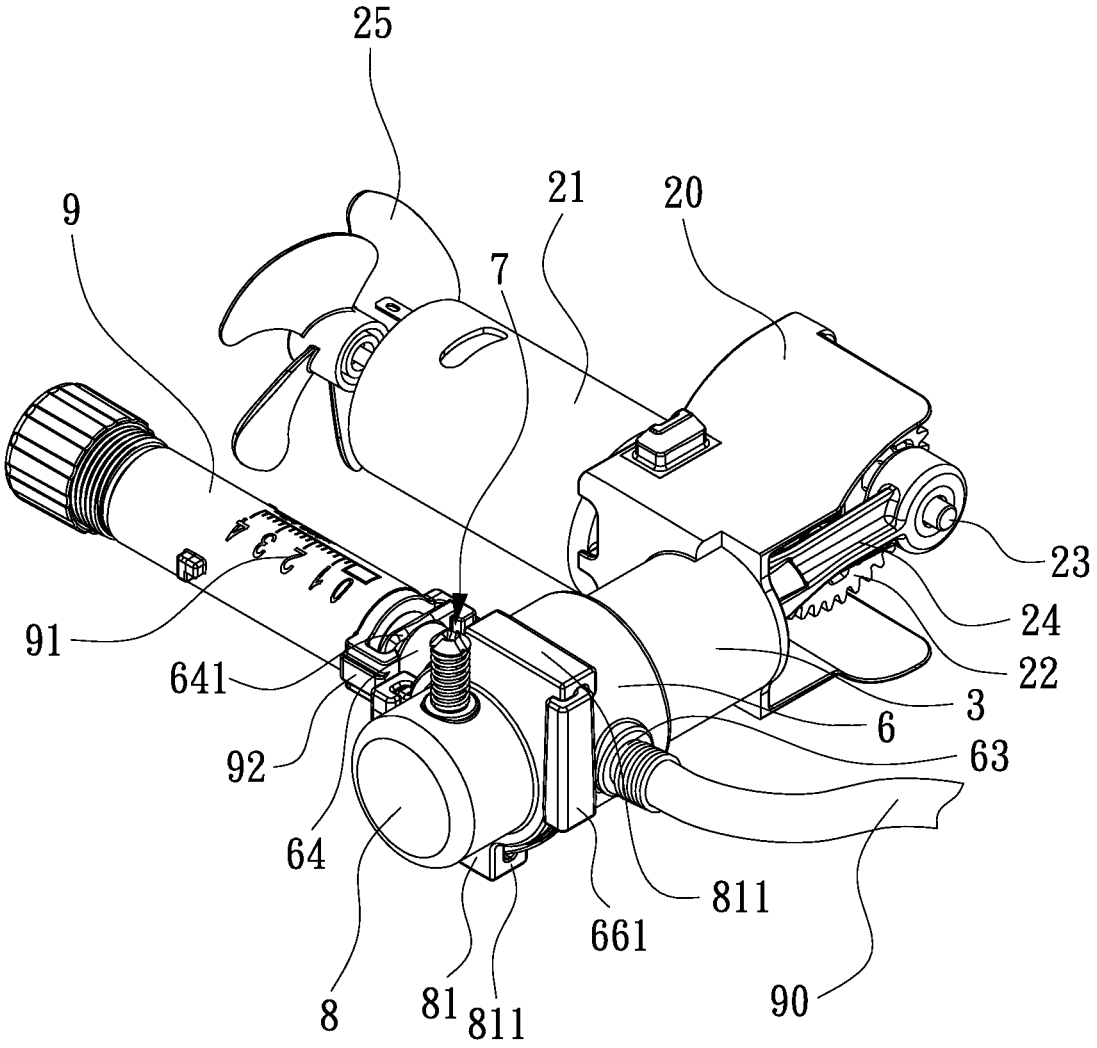
FIG. 6 shows a 3-dimensional view of a second embodiment of the compressor unit.
Figure 7:
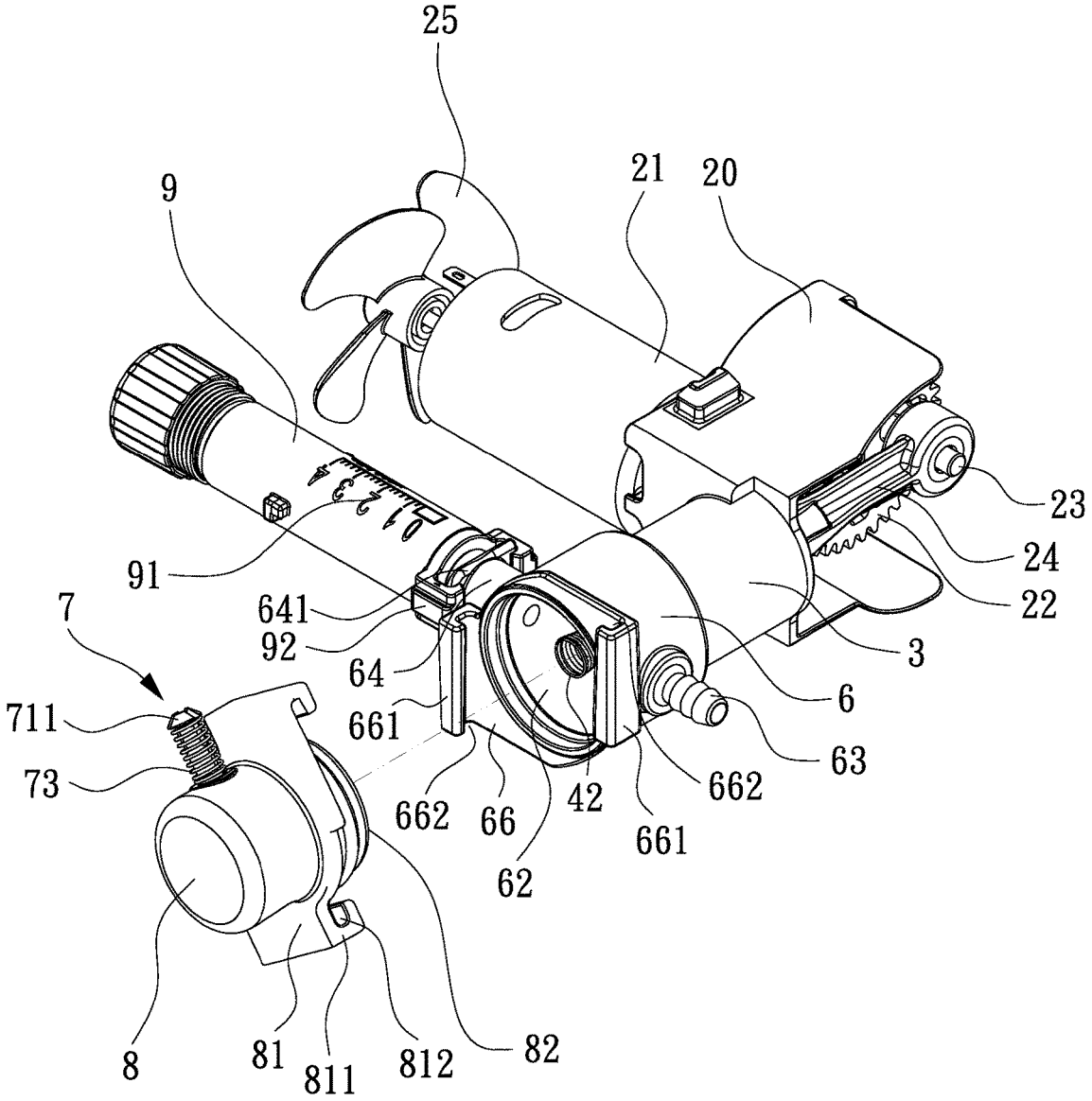
FIG. 7 shows an exploded view of the second embodiment of the compressor unit.
Figure 8:
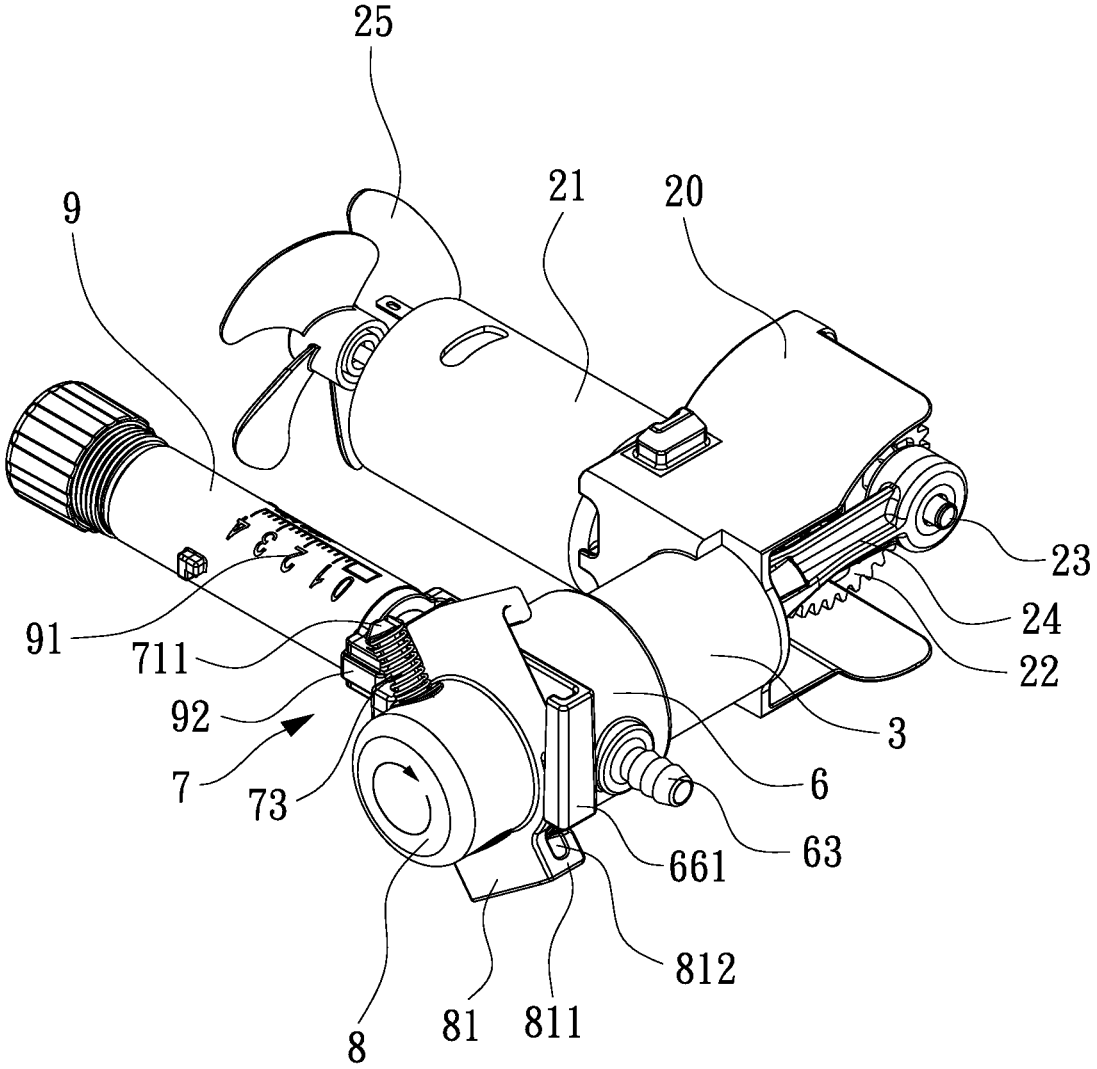
FIG. 8 shows an operational view of the second embodiment of the compressor unit, wherein a cylindrical cover is being fitted to a main container shell formed integrally with a cylinder thereof for completing an air storage container.

In normal condition, as shown in FIG. 4, wherein the pressure relieving mechanism 7 is not actuated, one end of the compression spring 73 is urged against the main container shell 6, and the other end of the compression spring 73 is urged against the resilient head 711. The urging force of the compression spring 73 causes the stem 71 to move outwardly of the main container shell 6, so that the seal ring 72 disposed at the stem 71 can be forced to tightly contact the inner surface of the surrounding wall 67 of the main container shell 6 around the through hole 65, thereby sealing the through hole 65. When a user depresses the push button 13 to move the stem 71 inwardly of the main container shell 6, as shown in FIG. 5, the seal ring 72 disposed at the stem 71 will be clear of the inner surface of the surrounding wall 67 of the main container shell 6, and thus the compressed air within the main container shell 6 can pass the through hole 65 to be released into the ambient environment. The push button 13 is provided with a stopping portion 131, which will touch the main container shell 6 when the push button 13 is depressed, so that stem 71 can be prevented from moving inwardly of the main container shell 6 too much.

When the piston body 24 conducts reciprocating motion within the cylinder 3, as shown in FIG. 5, the compressed air produced in the inner space 35 of the cylinder 3 can overcome the urging force of the compression spring 42 to move the plug 41 up, so that the compressed air can go through the through hole 32 of the partition wall 30 and the gaps 34 between the posts 33 to enter the air chamber 62 of the air storage container. Since the diameter of the air chamber 62 is preferably greater than the diameter of the inner space 35 of the cylinder 3, the motion resistance of the piston body 24 can be reduced and the pressure relieving mechanism 7 can be operated more easily.

FIGS. 6 through 10 shows a second embodiment of the compressor unit, wherein the air storage container is comprised of a main container shell 6 and a cover 8. A through hole 88 is defined at the cover 8 instead of the main container shell 6. The cover 8 is a cylindrical body 8, which has an inner space or air chamber 89 and a tubular connection portion 82 formed at its open bottom and a second coupling means. The second coupling means has two substantially opposite lateral plates 81 extending from the surrounding wall 80 of the cover 8. One side of each lateral plate 81 is formed into a second U-shaped holding portion 811 defining a second recess 812. The tubular connection portion 82 defines an annular groove 820 around its circumference to be fitted with a seal ring 86. The cover 8 is provided at its top inner surface with a central column 83 and an annular protrusion 84 around the central column 83, thus defining an annular groove 85 therebetween. The cover 8 is further provided with a plurality of spaced bars 87 extending from a bottom of the annular groove 85 and arranged around the central column 83, each of the bars 87 having a bottom edge 871.

Figure 9:
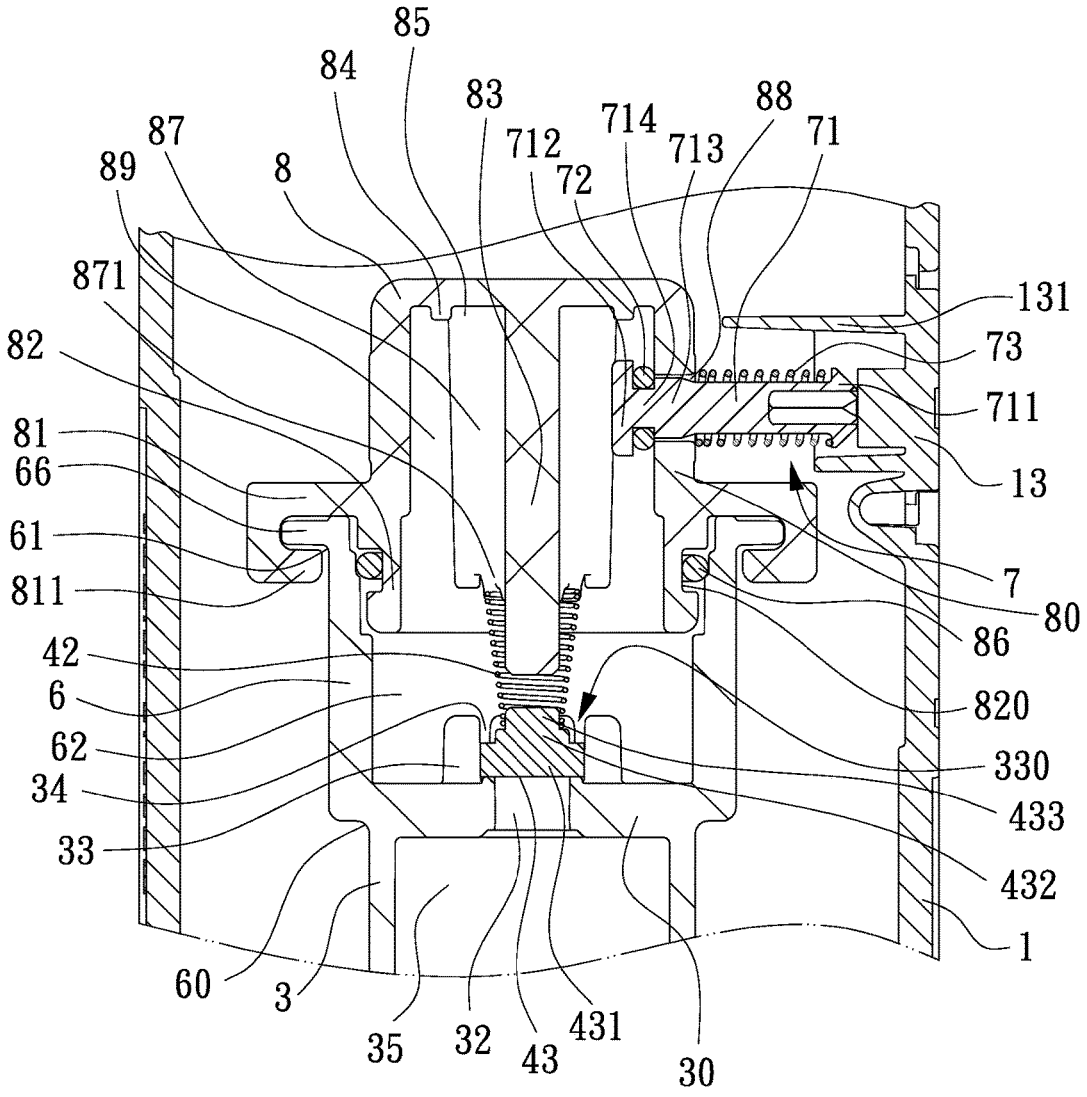
FIG. 9 shows a partially enlarged sectional view of the second embodiment of the compressor unit.

The pressure relieving mechanism 7, which is described in the first embodiment of the compressor unit, generally includes a stem 71, a seal ring 72, and a compression spring 73, wherein the stem 71 has a resilient head 711 at one end, a bottom plate 712 at the other end, a neck 714 next to the bottom plate 712, and a protrusion 713 next to the neck 714 (see FIG. 9). The seal ring 72 is fitted around the neck 714 of the stem 71. The stem 71 is located between two of the bars 87 and inserted through the through hole 88 of the cover 8 and fitted with the compression spring 73 such that the resilient head 711 is located outside the cover 8 and in contact with a push button 13 provided on the external enclosure 1 while the bottom plate 712 is located inside the cover 8. The seal ring 712 is engaged between the bottom plate 712 and the cover 8. The compression spring 73 is disposed between the resilient head 711 and the cover 8, so that the stem 71 can be moved outwardly of the cover 8 to have the seal ring 72 in tight contact with the inner surface of the surrounding wall 80 of the cover 8 around the through hole 88, and thus the seal ring 72 normally seals the through hole 88 of the cover 8.

The main container shell 6 of this embodiment is substantially same as the counterpart of the first embodiment of the compressor unit. The main container shell 6 and the cylinder 3 shares a partition wall 30 that defines a through hole 32 communicating the air chamber 62, 89 of the air storage container with the inner space 35 of the cylinder 3 (see FIG. 9). A plurality of posts 33 is formed on a top surface of the partition wall 30 and arranged around the through hole 32 thereof to define a central space 330 therebetween. There is a gap 34 existed between two adjacent posts 33. A valve mechanism includes a compression spring 42 and a plug 43. The compression spring 42 is disposed between the cover 8 and the plug 43. The plug 43 has three coaxial round portions including a bottom round portion 431, a middle round portion 432, and a top round portion 433, wherein the bottom round portion 431 has a diameter greater than the middle round portion 432, and the middle round portion 432 has a diameter greater than the top round portion 433. The plug 43 is urged by the compression spring 42 and located in the central space 330 surrounded by the posts 33, so that the plug 43 is confined by the posts 33 to prevent it from lateral movement under a force. The diameter of the bottom round portion 431 is smaller than the diameter of the central space 330 surrounded by the posts 33 but greater than the diameter of the through hole 32 of the partition wall 30. One end of the compression spring 42 is fitted around the top round portion 433 of the plug 43 while urged against the middle round portion 432, the other end of the compression spring 42 is fitted around the central column 83 and engaged the bottom edges 871 of the bars 87. The compressed air produced in the inner space 35 of the cylinder 3 can overcome the urging force of the compression spring 42 to move the plug 43 up, so that the compressed air can go through the through hole 32 of the partition wall 30 and the gaps 34 between the posts 33 to enter the air chamber 62, 89 of the air storage container. The open top 61 of the main container shell 6 is formed with a first coupling means that includes two substantially opposite lateral plates 66 extending outwardly from the surrounding wall of the main container shell 6. One side of each lateral plate 66 is formed into a first U-shaped holding portion 661 defining a first recess 662.

In assembling the cover 8 to the main container shell 6 (see FIGS. 6 through 10), the tubular connection portion 82 of the cover 8 can be inserted into the main container shell 6, and the cover 8 can be rotated about the main container shell 6 to allow its lateral plates 81 to slide in the first recesses 662 of the main container shell 6, and allow the lateral plates 66 of the main container shell 6 to slide in the second recesses 812, so that the cover 8 is detachably mounted to the main container shell 6 and thus seals the open top 61 of the main container shell 6, thereby completing an air storage container.

Figure 10:
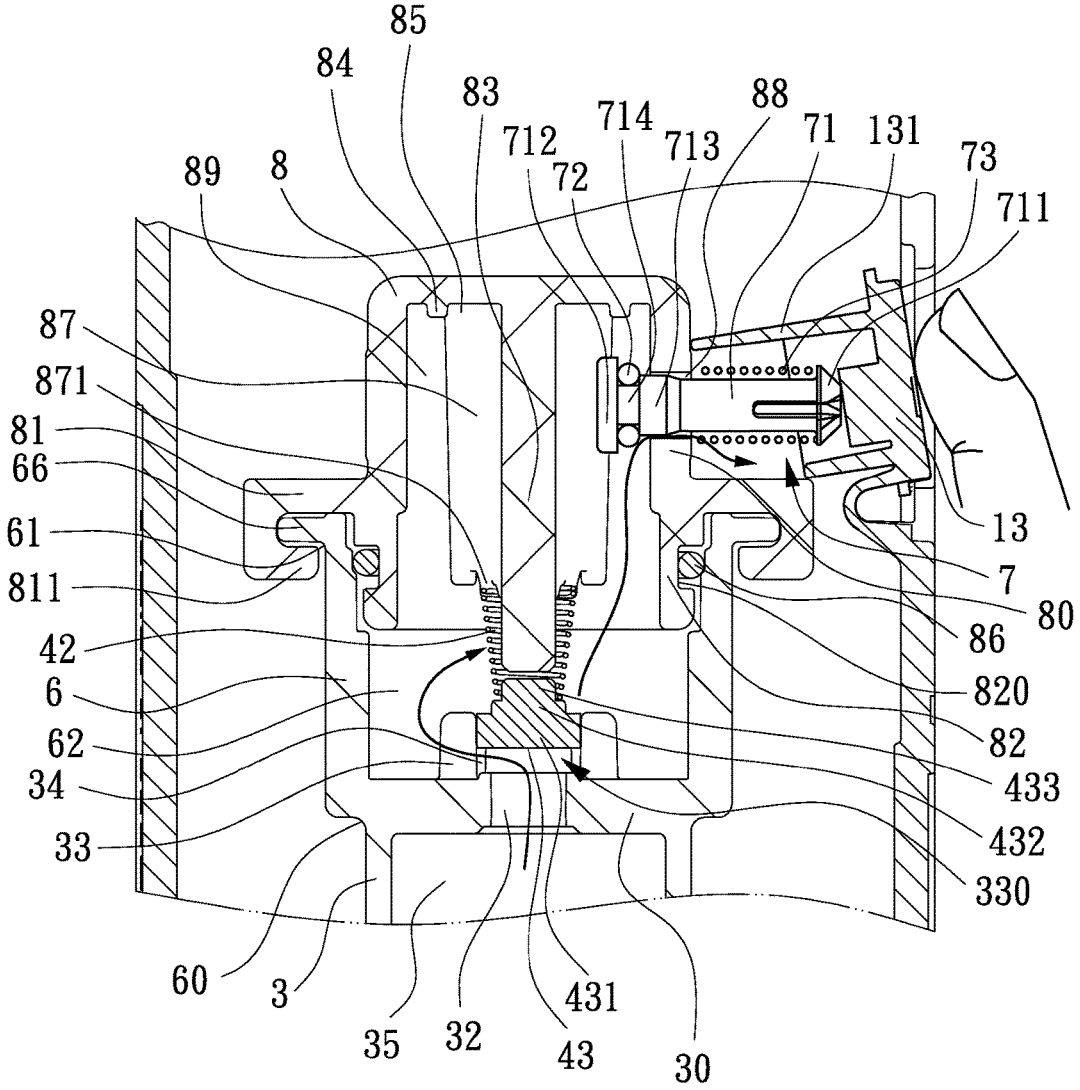
FIG. 10 shows an operational view of the second embodiment of the compressor unit, wherein a pressure relieving mechanism thereof is actuated for releasing the compressed air within an air storage container thereof into the ambient environment.

In normal condition, as shown in FIG. 9, wherein the pressure relieving mechanism 7 is not actuated, one end of the compression spring 73 is urged against the cover 8, and the other end of the compression spring 73 is urged against the resilient head 711. The urging force of the compression spring 73 causes the stem 71 to move outwardly of the cover 8, so that the seal ring 72 disposed at the stem 71 can be forced to tightly contact the inner surface of the surrounding wall 80 of the cover 8 around the through hole 88, thereby sealing the through hole 88. When a user depresses the push button 13 to move the stem 71 inwardly of the cover 8, as shown in FIG. 10, the seal ring 72 disposed at the stem 71 will be clear of the inner surface of the surrounding wall 80 of the main container shell 6, and thus the compressed air can pass the through hole 88 to be released into the ambient environment. The push button 13 is provided with a stopping portion 131, which will touch the cover 8 when the push button 13 is depressed, so that stem 71 can be prevented from moving inwardly of the cover 8 too much.

As a summary, one primary feature of the present invention is that the pressure reliving mechanism 7 is mounted such that one portion of the pressure relieving mechanism 7 is located in the air chamber 62, 89 of the air storage container while the other portion of the pressure relieving mechanism 7 extends out of the air storage container to be in contact with the pushbutton 13 provided at the external enclosure 1, so that a user can actuate the pressure relieving mechanism 7 easily by depressing the push button 13 on the external enclosure 1 to reduce the air pressure within the air storage container. A second feature of the present invention is that the air storage container is integrally formed with the cylinder 3, and the air chamber 62 of the air storage container has a diameter greater than or equal to the diameter of the inner space 35 of the cylinder 3. A third feature of the present invention is that the pressure relieving mechanism 7 is directly mounted to the air storage container rather than at one outlet provided at the air storage container, so that a user may operate the air compressor more safely and effectively.

I claim:

1. An air compressor that includes
an external enclosure and
an electrically-operated compressor unit inside the external enclosure,
the compressor unit including
a cylinder and
an air storage container defining therein an air chamber that communicates with an inner space of the cylinder,
the cylinder being fitted with a piston body driven by a motor for conducting reciprocating motion for producing compressed air in the inner space of the cylinder, a valve mechanism controlling the compressed air to enter the air chamber of the air storage container;
wherein the improvement comprises:
a pressure relieving mechanism is mounted to the air storage container,
wherein one portion of the pressure relieving mechanism is located in the air chamber of the air storage container while the other portion of the pressure relieving mechanism extends out of the air storage container to be actuated by a user for reducing the air pressure within the air storage container,
wherein the pressure relieving mechanism includes
a stem,
a seal ring, and
a compression spring,
the stem having
a resilient head at one end,
a bottom plate at the other end,
a neck next to the bottom plate, and
a protrusion next to the neck,
wherein the seal ring is fitted around the neck of the stem,
the stem is inserted through a through hole of the air storage container and fitted with the compression spring such that the resilient head is located outside the air storage container while the bottom plate is located inside the air storage container,
the seal ring is engaged between the bottom plate and the air storage container, and
the compression spring is disposed between the resilient head and the air storage container such that the seal ring normally seals the through hole, whereby depressing the resilient head will move the stem inwardly of the air storage container, so that the compressed air within the air storage container can be released into the ambient environment by way of the through hole of the air storage container, thereby reducing the air pressure.

2. An air compressor that includes
an external enclosure and
an electrically-operated compressor unit inside the external enclosure,
the compressor unit including
a cylinder and
an air storage container defining therein an air chamber that communicates with
an inner space of the cylinder,
the cylinder being fitted with a piston body driven by a motor for conducting reciprocating motion for producing compressed air in the inner space of the cylinder, a valve mechanism controlling the compressed air to enter the air chamber of the air storage container;
wherein the improvement comprises:
a pressure relieving mechanism is mounted to the air storage container,
wherein one portion of the pressure relieving mechanism is located in the air chamber of the air storage container while the other portion of the pressure relieving mechanism extends out of the air storage container to be actuated by a user for reducing the air pressure within the air storage container,
wherein the air storage container is comprised of a main container shell and
a cover,
the main container shell is formed integrally with the cylinder at its bottom,
the cover being capable of sealing an open top of the main container shell to define therein the air chamber,
the air chamber has a diameter greater than or equal to the inner space of the cylinder,
the main container shell and the cylinder sharing a partition wall that defines a through hole communicating the air chamber with the inner space of the cylinder,
a plurality of posts being formed on a top surface of the partition wall and arranged around the through hole thereof to define a central space therebetween,
the valve mechanism including
a plug and
a compression spring disposed between the cover and the plug,
the plug being urged by the compression spring and located in the central space surrounded by the posts so that the plug can be prevented from lateral movement under a force,
the open top of the main container shell being formed with a first coupling means that includes two substantially opposite lateral plates extending outwardly from the surrounding wall of the main container shell,
one side of each lateral plate being formed into a first holding portion defining a first recess.

3. The air compressor of claim 2, wherein a second through hole is defined on the main container shell to communicate the air chamber with the ambient environment,
the portion of the pressure relieving mechanism which extends out of the air storage container passes through the second through hole and is located outside the main container shell, and
actuation of the portion of the pressure relieving mechanism which extends out of the air storage container allows the compressed air within the air chamber to be released into the ambient environment.

4. The air compressor of claim 3, wherein the pressure relieving mechanism includes a stem, a seal ring, and a stem compression spring, the stem having a resilient head at one end, a bottom plate at the other end, a neck next to the bottom plate, and a protrusion next to the neck, wherein the seal ring is fitted around the neck of the stem, the stem is inserted through the second through hole of the main container shell and fitted with the stem compression spring such that the resilient head is located outside the main container shell and in contact with a push button provided on the external enclosure while the bottom plate is located inside the main container shell, the seal ring is engaged between the bottom plate and the main container shell, and the stem compression spring is disposed between the resilient head and the main container shell so that the seal ring normally seals the second through hole of the main container shell, whereby depressing the push button will move the stem inwardly of the main container shell, so that the compressed air within the air chamber of the air storage container can be released into the ambient environment by way of the second through hole of the main container shell, thereby reducing the air pressure.

5. The air compressor of claim 2, wherein the cover is a flat body having two substantially opposite lateral plates, one side of each lateral plate of the cover being formed into a second holding portion defining a second recess, the outer surface of the cover being provided with radial ribs to facilitate a user to operate the cover, the cover being formed with a tubular connection portion extending downwardly from its inner surface, the tubular connection portion defining an annular groove around its circumference to be fitted with a seal ring, the inner surface of the cover being further formed with a central column and an annular protrusion around the central column, thus defining an annular groove between the central column and the annular protrusion, one end of the compression spring of the valve mechanism is fitted around the central column and received in the annular groove; whereby the tubular connection portion of the cover is capable of being inserted into the main container shell, and the cover is capable of being rotated about the main container shell to allow its lateral plates to slide in the first recesses of the main container shell, and allow the lateral plates of the main container shell to slide in the second recesses, so that the cover is detachably mounted to the main container shell and thus seals the open top of the main container shell.

6. The air compressor of claim 2, wherein the cover is a cylindrical body having a tubular connection portion formed at its open bottom, the tubular connection portion defining an annular groove around its circumference to be fitted with a seal ring, the cover defining a second through hole at the surrounding wall thereof, the cover being provided at its top inner surface with a central column and an annular protrusion around the central column, thus defining an annular groove herebetween, the cover being further provided with a plurality of spaced bars extending from a bottom of the annular groove and arranged around the central column, each of the bars having a bottom edge, the pressure relieving mechanism including a stem, a seal ring, and a stem compression spring, the stem having a resilient head at one end, a bottom plate at the other end, a neck next to the bottom plate, and a protrusion next to the neck, wherein the seal ring is fitted around the neck of the stem, the stem being inserted through the second through hole of the cover and fitted with the stem compression spring such that the resilient head is located outside the cover while the bottom plate is located inside the cover, the stem compression spring being disposed between the resilient head and the cover, and the seal ring being engaged between the bottom plate and the cover.

7. The air compressor of claim 6, wherein the plug has three coaxial round portions including a bottom round portion, a middle round portion, and a top round portion, the bottom round portion having a diameter greater than the middle round portion, the middle round portion having a diameter greater than the top round portion, the plug being located in the central space surrounded by the posts so that the plug is confined by the posts to prevent it from lateral movement under a force, the diameter of the bottom round portion being smaller than the diameter of the central space surrounded by the posts but greater than the diameter of the through hole of the partition wall, one end of the compression spring being fitted around the top round portion of the plug while urged against the middle round portion, the other end of the compression spring is fitted around the central column and engaged the bottom edges of the bars.

* * * * *